US005535603A

United States Patent [19]

Hayakawa

[11] Patent Number: 5,535,603

[45] Date of Patent: Jul. 16, 1996

[54] ACCESSORIAL DEVICE

[75] Inventor: Haruo Hayakawa, Kofu, Japan

[73] Assignee: Twallje Co., Ltd., Yamanashi Prefecture, Japan

[21] Appl. No.: 351,085

[22] Filed: Nov. 30, 1994

[51] Int. Cl.[6] ..... A44C 5/00

[52] U.S. Cl. ..... 63/3; 63/2; 206/6.1

[58] Field of Search ..... 63/2, 3, 5.1, 7, 63/11; 383/11, 119; 229/67.1; 206/6.1

[56] References Cited

U.S. PATENT DOCUMENTS

| | | | |
|---|---|---|---|
| 3,900,060 | 8/1975 | Shammas | 206/6.1 |
| 4,388,959 | 6/1983 | Handy et al. | 206/6.1 |
| 4,602,734 | 7/1986 | Thompson | 229/67.4 |
| 4,753,828 | 6/1988 | Francis et al. | 63/12 |
| 5,031,758 | 6/1991 | Gonzalez | 206/6.1 |
| 5,074,127 | 12/1991 | Yurman | 63/3 |
| 5,119,641 | 6/1992 | Terry | 63/3 |
| 5,219,071 | 6/1993 | Knapp | 206/6.1 |
| 5,343,608 | 9/1994 | MacDonald | 63/3 |
| 5,367,891 | 11/1994 | Furuyama | 63/3 |

FOREIGN PATENT DOCUMENTS

| | | | |
|---|---|---|---|
| 271423 | 6/1988 | European Pat. Off. | 63/3 |
| 4-36821 | 2/1992 | Japan . | |

*Primary Examiner*—Michael J. Milano
*Attorney, Agent, or Firm*—Wenderoth, Lind & Ponack

[57] ABSTRACT

An accessorial device includes a flexible elongate member partly or wholly magnetized to form magnetic parts, a coating film with which the elongate member is entirely coated, a coating member with which the elongate member having been coated with the coating film is further coated, two caps fitted on opposite ends of the elongate member twice coated, and a decorative member mounted on the twice coated elongate member. The accessorial device assumes an annular shape of a diameter which is adjustable due owing to the flexibility of the elongate member and mutual magnetic attraction of the magnetic parts.

15 Claims, 8 Drawing Sheets

ACCESSORIAL DEVICE

BACKGROUND OF THE INVENTION

1. Field of the Invention

This invention relates to accessorial devices such as necklaces, bracelets, bangles, rings, string ties, belts, and others which are much longer relative to their width.

2. Description of the Prior Art

Conventional annular accessorial devices of this type have been worn around necks, arms, wrists, fingers, etc. with the loose opposite ends thereof joined to each other by means of a fastener.

In the case of a necklace, for example, the cordlike body such as a chain is looped around the user's neck with the opposite ends joined to each other by means of a hook and an eye or matched component pieces of a fastener attached to the ends. An endless necklace is used in a form simply looped two or three times around the user's neck.

The conventional accessorial device annoys the user because of the troublesome work of fastening and unfastening. The fasteners are very small in size and complicated in structure, and the accessorial device does not allow the user to loop it with a diameter of the user's own choice because the accessorial device has a fixed length and, therefore, produces a loop of a fixed diameter.

A prior art accessorial device is disclosed in Japanese UM-A-04-36821 and is formed of an elongate member partly or wholly magnetized to form magnetic parts, looped in a partly overlapping state so as to obtain a desired diameter, and attached by mutual attraction of two or more of the magnetic parts of the elongate member or attraction between some of the magnetic parts of the elongate member and corresponding parts adapted to be attracted magnetically.

The prior art accessorial device has been proposed by the present inventor for the purpose of solving the problem posed by the aforementioned conventional accessorial device. Various other considerations, such as safety, decorative beauty, display, safeguarding, and transportation of the accessorial device have encouraged the present inventor to pursue a diligent study resulting in the present invention.

The main object of this invention is to provide an ornamental accessory which permits adjustment of shape to suit the individual user, provides an improved appearance from the ornamental point of view, and renders display, safeguarding, and transportation possible.

SUMMARY OF THE INVENTION

To accomplish the object described above, according to this invention there is provided an accessorial device comprising a flexible elongate member partly or wholly magnetized to form magnetic parts, a coating film with which the elongate member is entirely coated, a coating member with which the coated elongate member is further coated, two caps fitted on opposite ends of the twice coated elongate member, and a decorative member mounted on the twice coated elongate member. The accessorial device can assume an annular shape of a diameter which is adjustable due to the flexibility of the elongate member and mutual magnetic attraction of the magnetic parts.

BRIEF DESCRIPTION OF THE DRAWINGS

The above and other objects, features and advantages of the present invention will become apparent to those skilled in the art from the following detailed description of the invention with reference to the accompanying drawings.

DETAILED DESCRIPTION OF THE PREFERRED EMBODIMENTS

The present invention will now be described in detail with reference to the illustrated embodiments.

FIG. 1 to FIG. 5 show one embodiment of a necklace type accessorial device according to the present invention.

The accessorial device comprises a flexible elongate member 1 partly or entirely magnetized to form magnetic parts 1*a* and 1*b*, a coating film 2*a* with which the elongate member 1 is entirely coated, a coating member 2 with which the coated elongate member 1 is entirely coated, two caps 3 fitted on opposite ends of the elongate member 1, and a decorative member 4 mounted on the elongate member 1.

The flexible elongate member 1 is formed into a cord by either shaping a magnetic material or molding a powdered magnetic material with extrusion molding means. Examples of the powdered magnetic material include a magnetite powder, a mixture of a ferrite powder and a rare earth element cobalt alloy powder. In molding such a powdered magnetic material, a molten resin is used as a binding agent. Optionally, an alloy composed of ground metal and a magnetic material may be shaped into a flexible elongate member 1.

Figure 4:
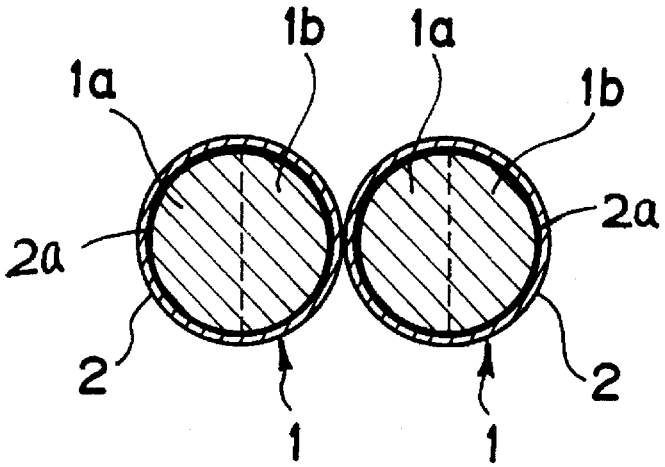
FIG. 4 is a cross section showing one example of a coated flexible elongate member of the accessorial device.

As illustrated in FIG. 4, the elongate member 1 is shaped in a circular cross section and is provided on the peripheral surface thereof with a colored coating film 2*a* and further with a transparent coating member 2. The colored coating film 2*a* is formed of, for example, a silicone resin, an epoxy resin, or an acrylic resin and applied by spray coating means, electrostatic coating means or vacuum deposition means to the peripheral surface of the elongate member 1. The transparent coating member 2 is applied to or deposited on the coating film 2*a*. The transparent coating member 2 is also formed of, for example, a silicone resin, an epoxy resin, or an acrylic resin.

When a transparent coating film 2*a* is used, a colored coating member 2 is used. When the elongate member 1 is colored, both the coating film 2*a* and the coating member 2 may be transparent.

In any of these cases, the coating member 2 is preferably made of a heat-shrinkable resin in the form of a hollow cylinder. The coating member 2 can be easily deposited on the elongate member 1, coated with the coating film 2*a* by inserting the coated elongate member 1 into a transparent or colored heat-shrinkable cylindrical coating member 2 and heating the coating member 2.

Figure 7:
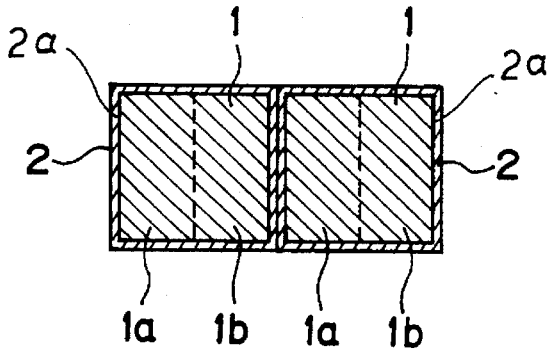
FIG. 7 is a cross section illustrating another example of the coated flexible elongate member.
Figure 8:
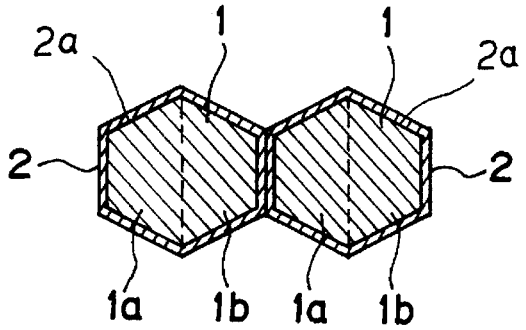
FIG. 8 is a cross section illustrating another example of the coated flexible elongate member.

The elongate member 1 may be shaped in a square cross section as shown in FIG. 7 or in a hexagonal cross section as shown in FIG. 8, or may be of any other shape.

The elongate member 1 is magnetized so as to create magnetic part 1*a* of one polarity (S pole, for example) and a magnetic part 1*b* of the opposite polarity (N pole, for example). The magnetic parts 1*a* and 1*b* are defined by a cross section perpendicular to the length of the elongate member 1. The two halves 1*a* and 1*b* of the magnetized elongate member 1 have a face-to-face relation in the lateral direction as shown in the examples of FIGS. 4, 6, 7 and 8.

Figure 9:
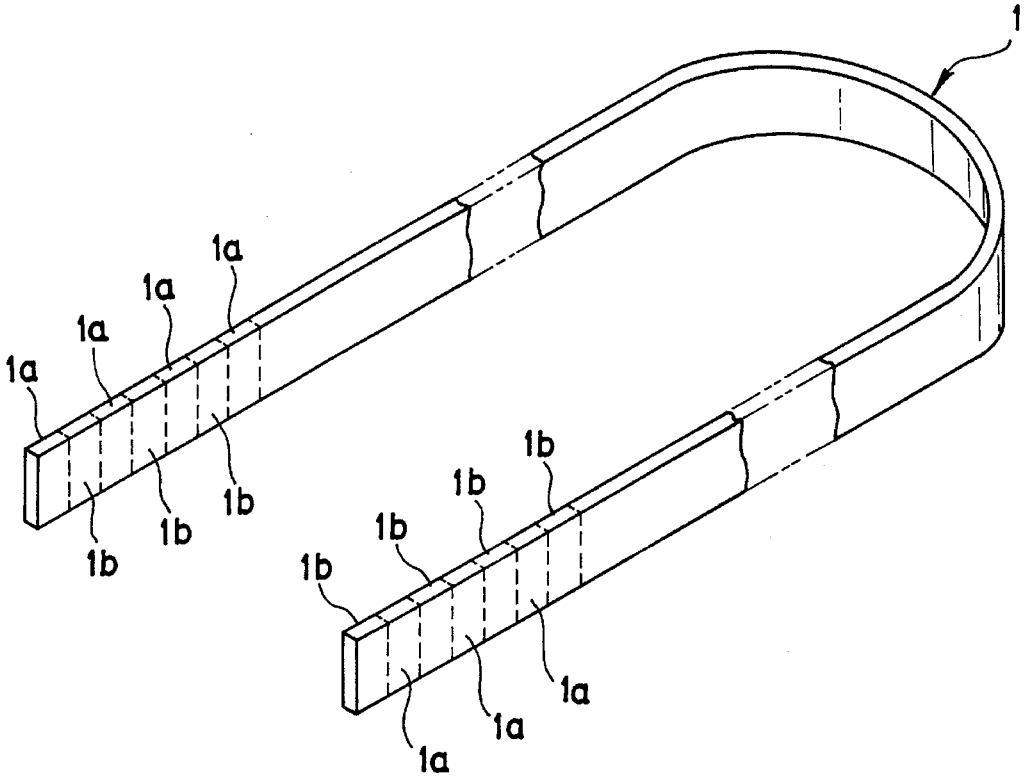
FIG. 9 is a cross section illustrating another example of the flexible elongate member.

Alternatively, the elongate member 1 may be formed in the shape of a slender thin sheet as illustrated in FIG. 9. In this example, magnetic parts 1*a* and 1*b* may be alternately disposed along the length of the elongate member 1 by magnetizing opposite end parts or the whole length of the elongate member 1.

In any one of these examples, the magnetic parts of elongate member 1 are attracted to each other in the lateral direction. In other words, when the elongate member 1 is wound, it assumes a flattened state. Therefore, it is advantageously used as a necklace type accessorial device.

Figure 6:
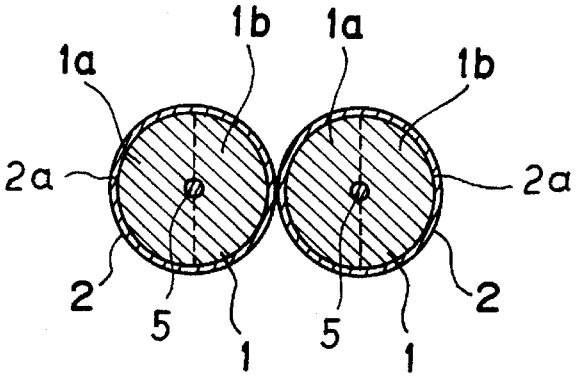
FIG. 6 is a cross section illustrating another example of the coated flexible elongate member.

Further, a slender rod-like core member 5 may be provided in the center of the elongate member 1, as shown in FIG. 6, so as to be retained in an elliptical shape, a square shape, or other suitable shape. Incidentally, the core member 5, for example, may be formed of stainless steel or copper wire.

Figure 12:
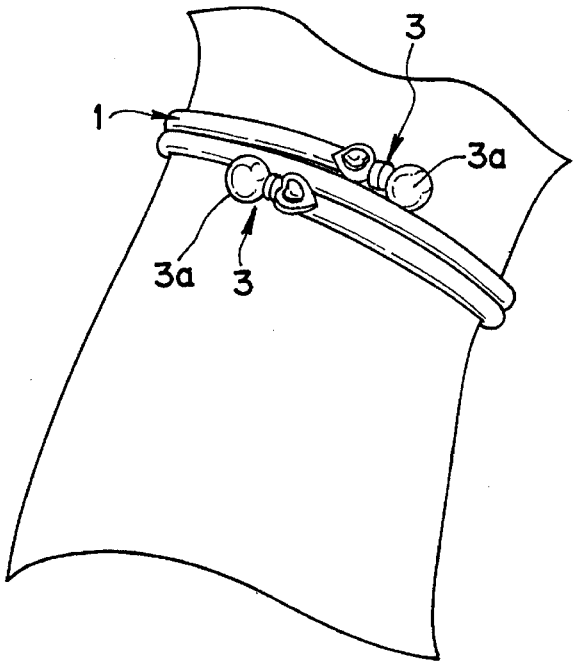
FIG. 12 is a perspective view illustrating another example of the caps of the accessorial device according to the present invention.
Figure 13:
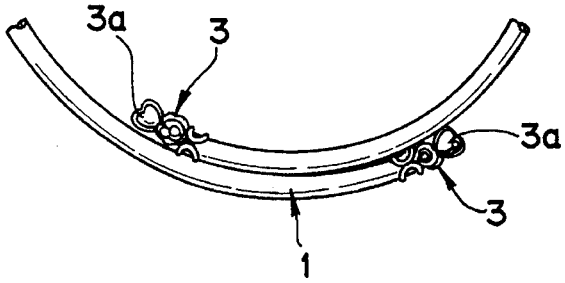
FIG. 13 is a front view illustrating still another example of the caps of the accessorial device.
Figure 14:
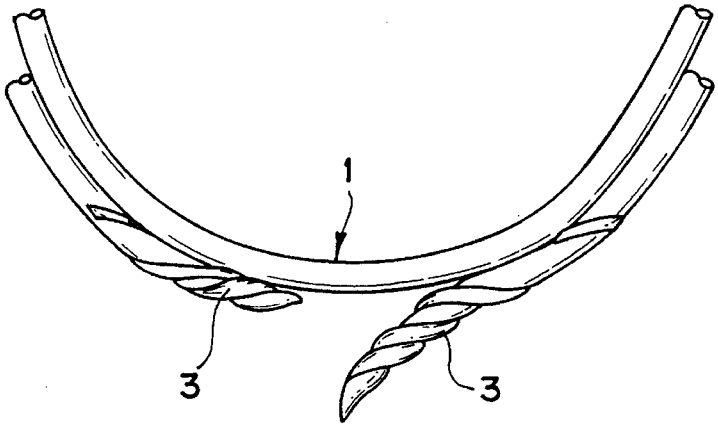
FIG. 14 is a front view illustrating yet another example of the caps of the accessorial device.

The caps 3 are formed of gold, silver, platinum or brass and adorned by color or gloss. The caps 3 serve the purpose of adding to the ornamental effect and protecting the opposite ends of the elongate member 1. The sensational quality of these caps 3 can be further enhanced by setting gems 3*a* such as diamonds and pearls in the caps 3 as shown in FIGS. 12 and 13. In the construction of FIG. 14, the caps 3 are fixed with an adhesive agent to the opposite ends of the elongate member 1.

Figure 5:
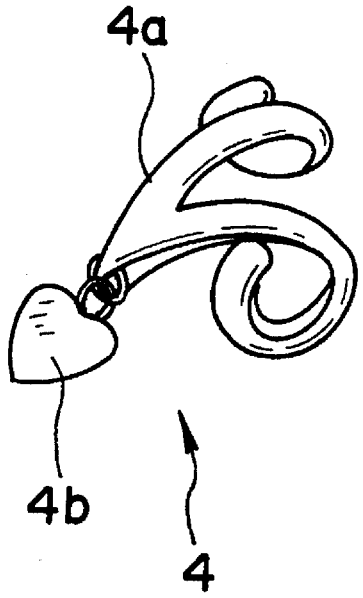
FIG. 5 is a perspective view illustrating one example of a decorative member of the accessorial device.

Further, the elongate member 1 can be made to acquire enhanced fashionability by attaching the decorative member 4 to the elongate member 1. The decorative member 4 used for the attachment is composed of a spiral insertion part 4*a*, which is adapted to allow passage of the elongate member 1 therethrough, and a cordate decorative part 4*b* as shown in FIG. 5, for example. Otherwise, the decorative member may be formed so as to be combined with a decorative member such as a commercially available pendant.

Figure 15:
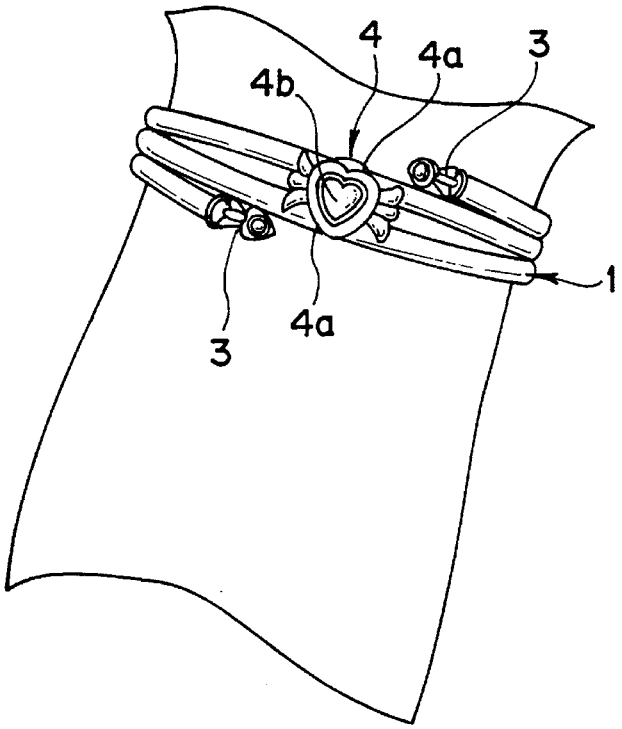
FIG. 15 is a perspective view illustrating another embodiment of a bracelet type accessorial device according to the present invention.
Figure 16:
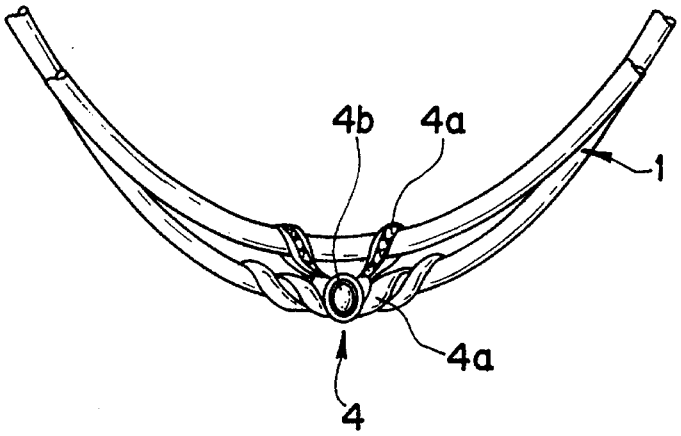
FIG. 16 is a partially cutaway front view illustrating still another embodiment of a necklace type accessorial device according to the present invention.

A more fanciful necklace is obtained by preparing a decorative member 4 provided with two insertion parts 4*a* adapted to allow passage therethrough of the elongate member 1 as shown in FIGS. 15 and 16 and then attaching the decorative member 4 to the elongate member 1 by passing the elongate member 1 through the two insertion parts 4*a*. This decorative member 4 has a decorative part 4*b* such as diamond or pearl fixed thereto.

Returning to FIGS. 1 to 3, the accessorial device can be advantageously displayed, safely kept and transported when combined with a container of the construction described hereinafter.

Figure 1:
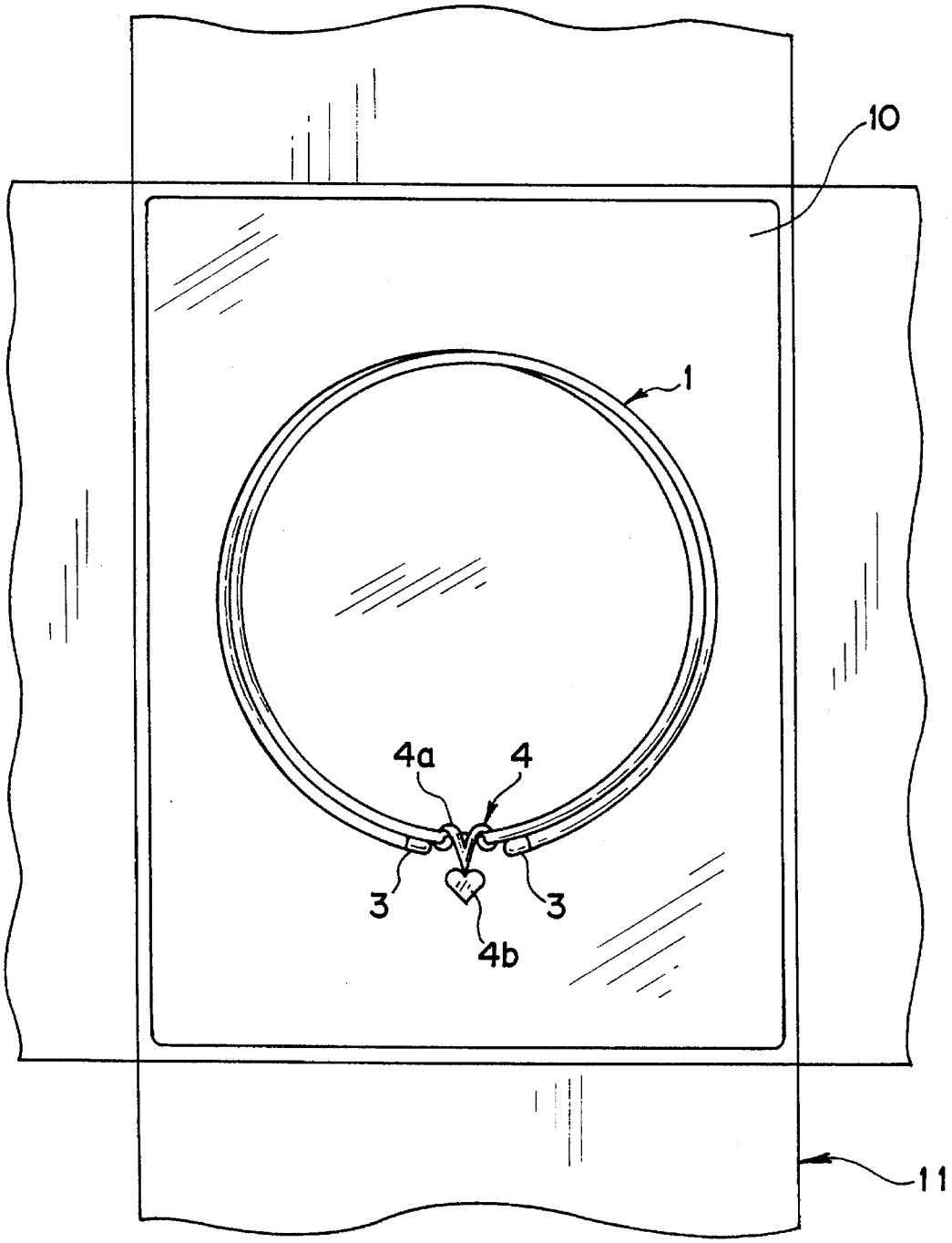
FIG. 1 is a front view illustrating one embodiment of a necklace type accessorial device and container according to the present invention.
Figure 2:
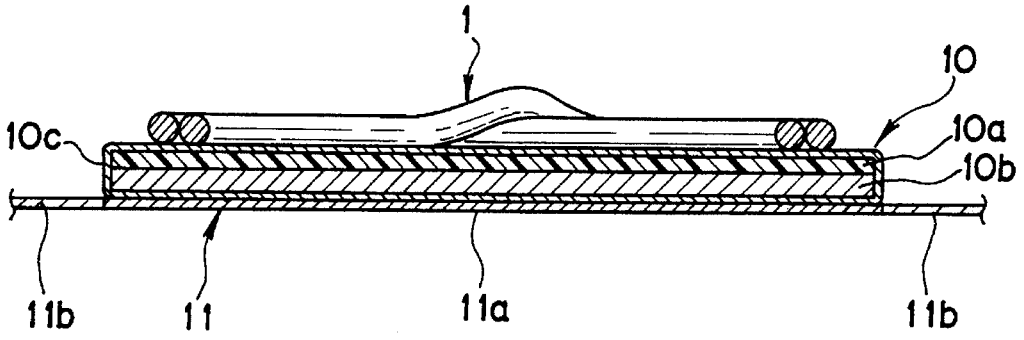
FIG. 2 is a longitudinal cross section of the embodiment shown in FIG. 1.
Figure 3:
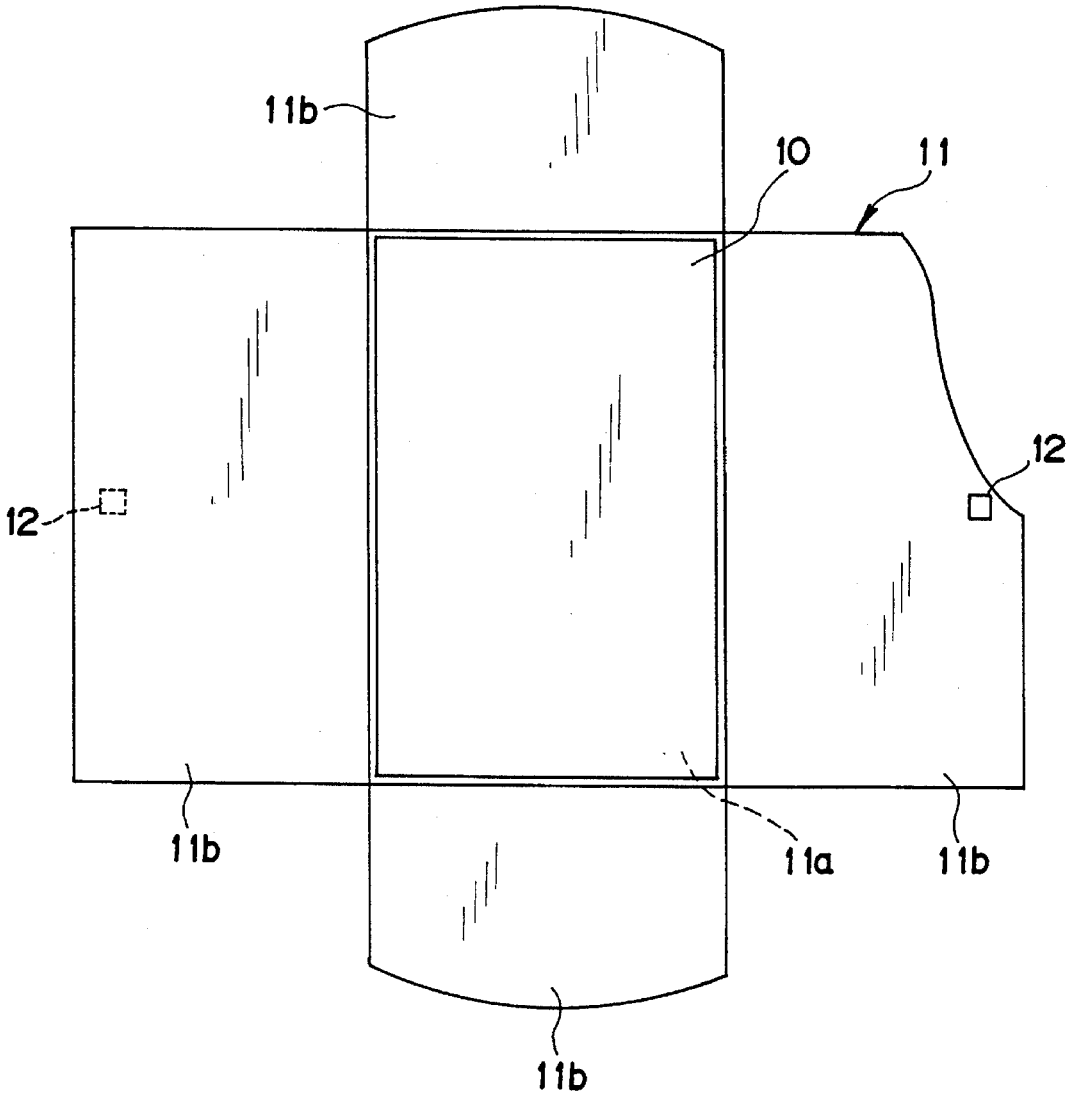
FIG. 3 is a front view showing the container.

The container for the accessorial device comprises a retaining member 10, large enough to store the elongate member 1 wound in one loop, and a spreadable cover 11 resembling a cloth. The retaining member 10 comprises a thin sheet 10*a* capable of being attracted by a magnetic force (such as, for example, a sheet made of stainless steel or iron), a base 10*b* made of paper (such as, for example, corrugated paper) and fixed to the rear surface of the thin sheet 10*a*, and an elastic covering material 10*c* (such as, for example, soft synthetic leather) adapted to enclose the thin sheet 10*a* and the base 10*b*. The spreadable cover 11 is folded so as to assume a shape similar to that of the retaining member 10. When the retaining member 10 has a square shape as shown in FIGS. 1 to 3, a central face 11*a* of the spreadable cover 11 is formed in a square shape approximately equal in size to the upper surface of retaining member 10 and foldable flaps 11*b* are provided at each of the four sides of the central face 11*a*. Binding tapes 12 are provided on at least one pair of opposite flaps 11*b*. By joining the binding tapes 12, the opposite flaps 11*b* overlap and are attached to each other. Examples of the material for the spreadable cover 11 are PVC, enamel, cloth, leather and synthetic leather may be used.

Figure 10:
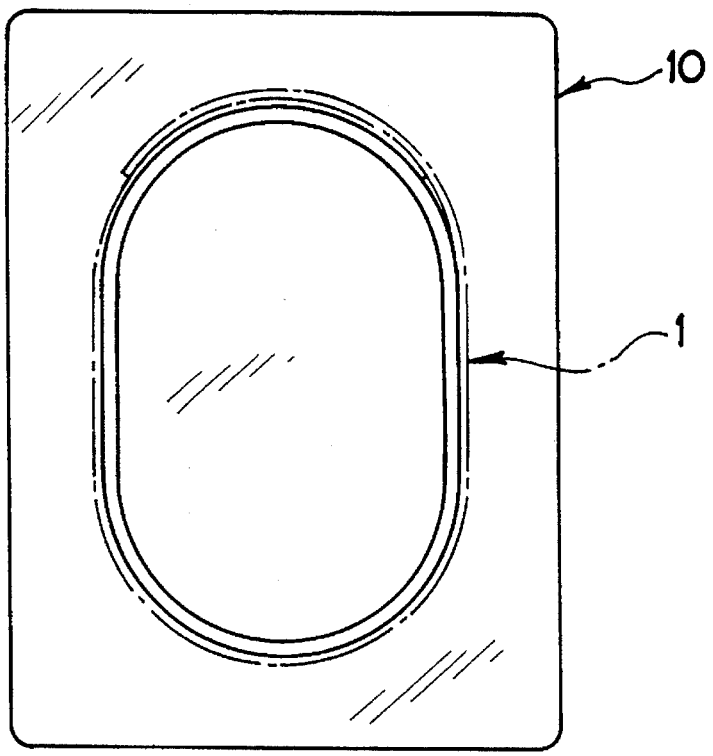
FIG. 10 is a front view illustrating another example of the retaining member of the container.
Figure 11:
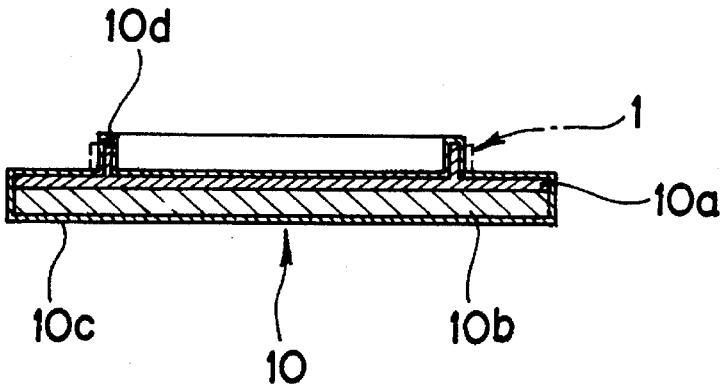
FIG. 11 is a longitudinal cross section of the retaining member shown in FIG. 10.

Further, for the purpose of fixing the elongate member 1 which is formed in the shape of a slender thin sheet, an approximately elliptic or circular projection 10*d* is formed on the upper surface of the thin sheet 10*a* and the elongate member 1 is attached to or wrapped around the outer peripheral surface of the projection 10*d* as illustrated in FIG. 10 and FIG. 11. When the elongate member 1 is to be attached to the projection 10*d*, the projection 10*d* may be formed of the same material as the thin sheet 10*a*.

In shaping or molding an elongate member, the elongate member is wound in an annular shape. For this reason, the elongate member 1 tends to form an annular shape even after being cut into a length suitable for a necklace, a bracelet, etc. The elongate member 1 is magnetized to create magnetic parts 1*a* and 1*b* which will attract and overlap each other in a planar state as illustrated in FIG. 1. When elongate member 1 is magnetized, so that the parts thereof attract and are superposed like a coil spring as shown in FIG. 12 or FIG. 15, it can be advantageously used as a bracelet or the like accessorial device. Furthermore, since the elongate member can be twisted around itself in a superposed state to induce mutual attraction of the magnetic parts 1*a* and 1*b* thereof, it can be made to form a decoration of a more personal character by suitable variation of shape.

The coating member 2 is formed of a silicone resin, an epoxy resin, an acryl resin or a heat-shrinkable resin. It allows the elongate member 1 to contact the user's skin safely, prevents the elongate member 1 from deterioration by aging, and imparts an improved outward appearance. The elongate member 1 can retain its annular shape and the coating member 2 follows the shape of the elongate member 1. The elongate member 1 having the core member 5 disposed in the center thereof can also be retained in a suitably varied shape.

Further, the coating film 2a prepared in a varying color and deposited on the outer peripheral surface of the elongate member 1 can impart the varying color to the elongate member 1, reinforce the elongate member 1, and alleviate stresses exerted on the elongated member 1 during the process of varying the shape or form thereof.

After the coating member 2 has been deposited, it can be made to enrich the variegation of color thereof by subjecting the outer surface of the coating member 2 to the silk-screen process. By performing the silk-screen process on the outer peripheral surface of the coating member 2, the color scheme of an elongate member 1, formed in the shape of a rectangular column, can be enriched by imparting a red color to one pair of opposite lateral sides and a golden color to the other pair of opposite lateral sides.

Since, the magnetic poles are disposed along the length of the elongate member in the cross sections perpendicularly intersecting the length of the elongate member 1, the elongate member 1 is able to effect magnetic attraction throughout the entire periphery thereof. When the elongate member 1 is magnetized by having the magnetic poles disposed alternately along the length of the elongate member 1, the magnetic parts 1*a* and 1*b* are magnetically attracted to each other so as to be fixed in a locked state. Thus, the elongate member 1 may be adjusted into a suitable fixed configuration.

The elongate member 1 having a cross sectional shape of a square or a hexagon, has a larger surface for magnetic attraction and thereby provides a greater attractive force than when it has a circular cross section.

In the case of a bracelet type accessorial device, appearance of the elongate member 1 is enhanced by simply providing caps 3 at the opposite ends thereof. Further, since the elongate member 1 allows the decorative member 4 to be positioned approximately at the center thereof, it can be used in the same manner as a necklace. It can be put on the user's body easily because there is no need for a fastener.

The accessorial device obtained by shaping the elongate member in a desired annular shape, when magnetically attached to the retaining member of the container, can be used as a display. By wrapping the accessorial device and the retaining member with the spreadable cover of the container, the accessorial device can be safely stored and transported. When the accessorial device is not in use, it can be stored safely and in a magnetically attracted state and, therefore, the shape of the accessorial device can be retained. Thus, the device, while in use, can be always be worn in a beautiful form on the user's body.

As described in detail above, this invention provides an accessorial device which is easily attached to the user's body, can be shaped to suite the individual, the appearance can be enhanced by combination with varying decorative members, and permitted to enjoy improved safety on the user's body and enhanced versatility of use.

This invention also provides an accessorial device with a container which allows the accessorial device formed in a desired shape, to be displayed. The container also enables the accessorial device to retain a desired shape when stored or transported.

What is claimed is:

1. An ornamental accessory comprising:

a partly or wholly magnetized flexible elongate member forming magnetic portions and having first and second ends;

a coating film entirely covering said elongate member;

a coating member overlying said coating film, said coating member being formed of a heat-shrinkable resin in the shape of a hollow cylinder;

a first cap fitted on said first end of said elongate member;

a second cap fitted on said second end of said elongate member; and a decorative member mounted on said elongate member, said accessory having an annular shape of variable diameter due to the flexibility of said elongate member and mutual magnetic attraction of said magnetic portions.

2. The device as claimed in claim 1, wherein said coating film is formed of one member selected from the group consisting of a silicone resin, an epoxy resin and an acrylic resin.

3. The device as claimed in claim 1, wherein said coating film is applied to said elongate member by means of spray coating, electrostatic coating or vacuum deposition.

4. The device as claimed in 1, wherein said coating member is formed of one member selected from the group consisting of a silicone resin, an epoxy resin and an acrylic resin.

5. The device as claimed in 1, wherein said coating member is applied to said elongate member by means of spray coating, electrostatic coating or vacuum deposition.

6. The device as claimed in claim 1, wherein said coating member is transparent and said coating film has a color.

7. The device as claimed in claim 1, wherein said coating member has a color and said coating film is transparent.

8. The device as claimed in claim 1, wherein said elongate member is provided with a core member in a center thereof.

9. The device as claimed in claim 1, wherein said magnetic parts have poles different in polarity and are disposed along a length of said elongate member on opposite sides of a cross section perpendicularly intersecting a length of said elongate member.

10. The device as claimed in claim 1, wherein said magnetic parts have poles different in polarity and disposed alternately along a length of said elongate member.

11. A combination of an ornamental accessory and a container, said accessory comprising a partly or wholly magnetized flexible elongate member having first and second ends and forming magnetic portions, a coating film entirely covering said elongate member, a coating member overlying said coating film, a first cap fitted on said first end of said elongate member, a second cap fitted on said second end of said elongate member, and a decorative member mounted on said elongate member, said accessory having an annular shape of variable diameter due to the flexibility of said elongate member and mutual magnetic attraction of said magnetic portions; and said container comprising a retaining member of sufficient size to accommodate said elongated member when wound in one loop and a cover folded in a shape similar to the shape of said retaining member, wherein said retaining member includes a thin sheet of stainless steel or iron, a paper base fixed to a rear surface of said thin sheet, and a synthetic material covering said thin sheet and said base.

12. The combination as claimed in claim 11, wherein said retaining member has a square shape and said cover includes a central face formed in a square shape approximately equal in size to said retaining member, a foldable flap provided at each side of said central face, and binding tapes provided on at least one pair of opposite flaps for joining said opposite flaps together in an overlapped state.

13. The combination as claimed in claim 11, wherein said cover is made of one member selected from the group consisting of PVC, enamel, cloth, leather and synthetic leather.

14. The combination as claimed in claim 11, wherein said retaining member further includes a projection on an upper surface of said thin sheet.

15. The combination as claimed in claim 11, wherein said projection is formed of the same material as said thin sheet.

* * * * *